US006869034B2

(12) United States Patent
Glaser

(10) Patent No.: US 6,869,034 B2
(45) Date of Patent: Mar. 22, 2005

(54) FUEL INJECTOR VALVE

(75) Inventor: Andreas Glaser, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/399,369

(22) PCT Filed: Jun. 12, 2002

(86) PCT No.: PCT/DE02/02148

§ 371 (c)(1),
(2), (4) Date: Sep. 10, 2003

(87) PCT Pub. No.: WO03/018994

PCT Pub. Date: Mar. 6, 2003

(65) Prior Publication Data

US 2004/0035955 A1 Feb. 26, 2004

(30) Foreign Application Priority Data

Aug. 20, 2001 (DE) ..... 101 40 795

(51) Int. Cl.[7] ..... B05B 1/30
(52) U.S. Cl. ..... 239/585.5; 239/585.1
(58) Field of Search ..... 239/585.1–585.5, 239/900

(56) References Cited

U.S. PATENT DOCUMENTS 4,766,405 A 8/1988 Daly et al.
6,170,767 B1 * 1/2001 Herold et al. ..... 239/585.3

FOREIGN PATENT DOCUMENTS

| | | | |
|---|---|---|---|
| DE | 198 49 210 | | 4/2000 |
| DE | 199 50 761 | | 4/2001 |
| DE | 100 43 085 | | 3/2002 |
| WO | WO 99/31379 | * | 6/1999 |

* cited by examiner

*Primary Examiner*—Christopher Kim
(74) *Attorney, Agent, or Firm*—Kenyon & Kenyon

(57) ABSTRACT

A fuel injector, in particular a fuel injector for fuel-injection systems of internal combustion engines, includes a valve needle cooperating with a valve-seat surface to form a sealing seat, and has an armature engaging with the valve needle, the armature being axially moveable on the valve needle and damped by a damping element made of an elastomer. The damping element is positioned in a recess of the armature at the valve needle in such a way that the valve needle is connected to the armature in the radial direction via the damping element.

8 Claims, 1 Drawing Sheet

FUEL INJECTOR VALVE

FIELD OF THE INVENTION

The present invention relates to a fuel injector.

BACKGROUND INFORMATION

U.S. Pat. No. 4,766,405 describes a fuel injector that includes a valve-closure member which is joined to a valve needle and cooperates with a valve-seat surface formed on a valve-seat member to form a sealing seat. For the electromagnetic actuation of the fuel injector, a magnetic coil is provided which cooperates with an armature that is joined to the valve needle by force-locking. An additional mass having a cylindrical form is provided around the armature and the valve needle, the mass being connected to the armature via an elastomeric layer.

The disadvantage with this is particularly the costly design that includes an additional component. In addition, the large surfaced elastomer ring is disadvantageous for the pattern of the magnetic field and hinders the closing of the field lines, and thus the achievement of high attractive forces during the opening movement of the fuel injector.

U.S. Pat. No. 4,766,405 describes another embodiment of a fuel injector in which, for damping and debouncing, an additional cylindrical mass is provided around the armature and the valve needle, which is moveably braced and held in its position by two clastomeric rings. When the valve needle strikes the sealing seat, this second mass can move relative to the armature and the valve needle and prevent bouncing of the valve needle.

The disadvantage of this described specific embodiment is the additional cost and space requirement. Also, the armature itself is not decoupled, so that its momentum increases the bouncing tendency of the valve needle.

U.S. Pat. No. 5,299,776 describes a fuel injector having a valve needle and an armature, where the armature is movably guided on the valve needle. The armature movement in the lift direction of the valve needle is limited by a first stop and its movement counter to the lift direction by a second stop. Within certain limits, the axial play of the armature, defined by the two stops, leads to a decoupling of the inert mass of the valve needle on the one hand, and the inert mass of the armature on the other hand. This counteracts to some extent a bouncing back of the valve needle from the valve-seat surface upon closing of the fuel injector. However, since the axial position of the armature relative to the valve needle is totally undefined by the free movement of the armature relative to the valve needle, bounces are avoided only to a limited extent. In particular, in the design of the fuel injector of U.S. Pat. No. 5,299,776 it is not avoided that the armature strikes the stop facing the valve-closure member during the closing movement of the fuel injector, thereby rapidly transmitting its momentum to the valve needle. This sudden transfer of linear momentum may cause additional bounces of the valve-closure member.

Furthermore, it is known in practice to fasten the armature, which is movably positioned on the valve needle, by using an elastomeric ring so that it is movably clamped in its position. For this purpose, the armature is held between two stops, an elastomeric ring being situated between the armature and lower stop. With this arrangement, however, the problem arises that a borehole through the armature is necessary for the supply of fuel to the valve-sealing seat. The bore through the armature is implemented close to the valve needle, so that it may occur that the elastomeric ring covers the bore.

SUMMARY OF THE INVENTION

In contrast, the fuel injector according to the present invention has the advantage over the related art that a damping element radially damps the armature and the valve needle with respect to one another in that a hollow-cylindrical elastomeric part is slid over the valve needle and the two components are together inserted in a recess of the armature. In this way, both needle bounce and armature bounce are damped in an effective manner.

In an advantageous manner, the surfaces of the damping element are vulcanized in order to produce better adhesion between the damping element made of elastomeric material and the metallic components, valve needle and armature.

Particularly advantageous is the separation of the fuel path through the fuel injector from the damping element, the damping element thus remaining undamaged and being unable to stray from its position under the influence of the fuel pressure, thereby extending the service life of the fuel injector.

DETAILED DESCRIPTION

Figures 1, 2:
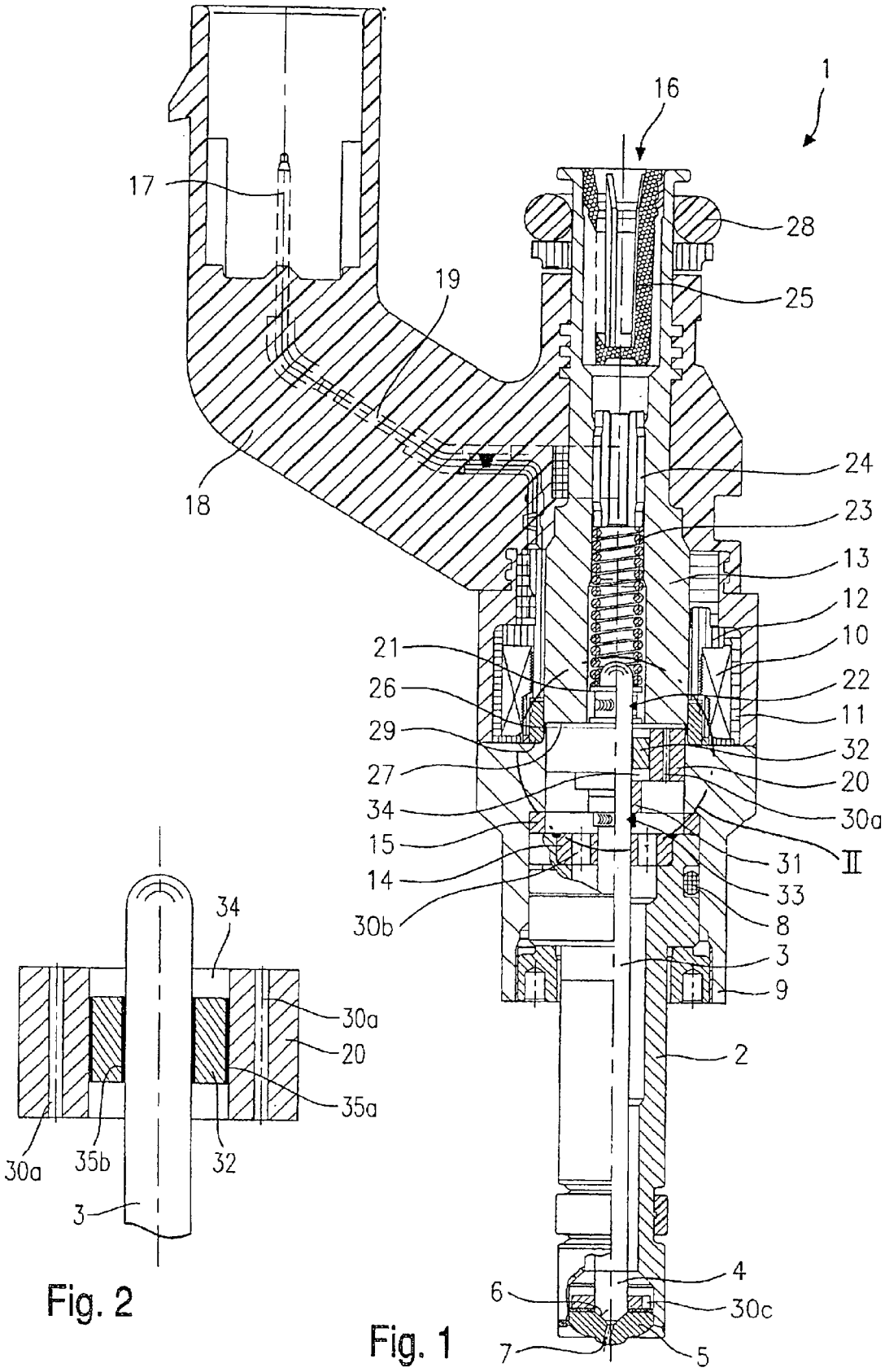
FIG. 1 shows a schematic section through an exemplary embodiment of a fuel injector configured according to the present invention, in an overall view.
FIG. 2 shows a schematic longitudinal section through the fuel injector configured according to the present invention as shown in FIG. 1, in area II in FIG. 1.

An exemplary embodiment of a fuel injector 1 configured according to the present invention as shown in FIG. 1 is designed in the form of a fuel injector for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 is in operative connection with valve-closure member 4, which cooperates with a valve-seat surface 6, located on a valve-seat member 5, to form a sealing seat. In the exemplary embodiment, fuel injector 1 is an inwardly opening fuel injector 1, which has one spray-discharge orifice 7. Nozzle body 2 is sealed from outer pole 9 of a magnetic coil 10 by a seal 8. Magnetic coil 10 is encapsulated in a coil housing 11 and wound on a coil brace 12, which rests against an inner pole 13 of magnetic coil 10. Inner pole 13 and outer pole 9 are separated from one another by a constriction 26 and are interconnected by a non-ferromagnetic connecting part 29. Magnetic coil 10 is energized via a line 19 by an electric current which may be supplied via an electrical plug contact 17. A plastic extrusion coat 18, which maybe extruded onto inner pole 13, encloses plug contact 17.

Valve needle 3 is guided in a valve-needle guide 14, which is disk-shaped. A paired adjustment disk 15 is used to adjust the (valve) lift. Armature 20 is on the other side of adjustment disk 15. Via a first flange 21, it is in force-locking connection to valve needle 3 which is connected to first flange 21 by a welded seam 22. Braced on first flange 21 is a restoring spring 23 which is provided with an initial stress by a sleeve 24 in the present design of fuel injector 1. Downstream from armature 20 is a second flange 31, which is connected to valve needle 3 by force-locking via a welded seam 33 and serves as lower armature stop.

Fuel channels 30*a* through 30*c* run in valve-needle guide 14, in armature 20 and valve-seat member 5. The fuel is supplied via a central fuel feed 16 and filtered by a filter element 25. A seal 28 seals fuel injector 1 from a distributor line (not shown further).

According to the present invention, fuel injector 1, in a recess 34 of armature 20, is provided with a damping element 32 which is designed as a hollow cylinder and penetrated by valve needle 3. Damping element 32 maybe made of an elastomeric material, such as rubber, and is joined by force-locking to armature 20 on one side, and to valve needle 3 on the other side, in such a manner that the axial movements of the mentioned components are damped with respect to each other. In this way, it is possible to prevent armature bounce both during the opening in the upper lift position and also during closing of fuel injector 1 in the lower lift position of armature 20.

The measures according to the present invention are represented in detail in FIG. 2 and explained more clearly in the following description.

In the rest state of fuel injector 1, armature 20 is acted upon by restoring spring 23 in a direction opposite to its lift direction, in such a manner that valve-closure member 4 is sealingly held against valve seat 6. In response to excitation of magnetic coil 10, it generates a magnetic field which moves armature 20 in the lift direction, counter to the spring force of restoring spring 23, the lift being predefined by a working gap 27 which occurs in the rest position between inner pole 12 and armature 20. First flange 21, which is welded to valve needle 3, is taken along by armature 20 in the lift direction as well. Valve-closure member 4, being in connection with valve needle 3, lifts off from valve-seat surface 6, and the fuel is spray-discharged through spray-discharge orifice 7.

In response to interruption of the coil current, following sufficient decay of the magnetic field, armature 20 falls away from inner pole 13 due to the pressure of restoring spring 23, whereupon first flange 21, being connected to valve needle 3, moves in a direction counter to the lift. Valve needle 3 is thereby moved in the same direction, causing valve-closure member 4 to set down on valve seat surface 6 and fuel injector 1 to be closed.

In a part-sectional view, FIG. 2 shows an enlarged view of region II in FIG. 1. Shown are armature 20 with damping element 32 and the inflow-side end of valve needle 3. For the sake of clarity, the remaining components situated in this region have been omitted.

As already mentioned earlier, fuel injector 1 in its preferred embodiment has a damping element 32 which is positioned in an axial recess 34 of armature 20.

Damping element 32 is designed as a hollow cylinder and preferably made of an elastomeric material, such as rubber. For the force-locking connection of damping element 32 to armature 20 and to valve needle 3, damping element 32 is provided with vulcanized layers 35*a* and 35*b*, which rest against recess 34 of armature 20 and valve needle 3 and, by pressure and static friction, provide for an elastic connection between armature 20 and valve needle 3. Damping element 32 is restricted in its axial length only by the axial length of recess 34 of armature 20. The length and the wall thickness of damping element 32 are selected mainly under the aspect of manufacturing and assembly technology and also durability during continuous operation.

The movements of armature 20 and of valve needle 3 with respect to one another may be effectively damped by the elastic connection, thereby avoiding armature bounce at first sleeve 21 during opening of fuel injector I and at second sleeve 31 during closing of fuel injector 1. The movement of valve needle 3 is also damped, so that valve-needle bounce in the sealing seat is likewise avoided. As a consequence, the dynamics of fuel injector 1 are improved, so that it is possible to realize shorter opening and closing times in combination with faster switching cycles and smaller and more precise metered quantities.

By a separation of the fuel path through fuel injector 1, which guides fuel through armature 20 by way of fuel channels 30*a*, from damping element 32 in recess 34 of armature 20, damping element 32 is not damaged by the corrosive fuel. There is also no danger of damping element 32 leaving recess 34 of armature 20, due to the prevailing fuel pressure, and being consequently damaged. Slight movements along valve needle 3, on the other hand, do not affect the functioning.

The present invention is not limited to the exemplary embodiment shown and is also applicable, for instance, to outwardly opening fuel injectors 1.

What is claimed is:

1. A fuel injector, comprising:

a valve-seat surface;

a valve needle that cooperates with the valve-seat surface to form a sealing seat;

a damping element made of an elastomer;

an armature that engages with the valve needle, the armature being axially moveable on the valve needle and being damped by the damping element; and a first vulcanized layer, wherein:

the damping element is positioned in a recess of the armature at the valve needle in such a way that the valve needle is connected to the armature in a radial direction via the damping element, and the armature, by way of the first vulcanized layer, is connected to the damping element in a force-locking manner.

2. The fuel injector as recited in claim 1, wherein:

the fuel injector is for a fuel-injection system of an internal combustion engine.

3. The fuel injector as recited in claim 1, wherein:

the damping element includes a hollow cylinder.

4. The fuel injector as recited in claim 1, wherein:

the valve needle penetrates the damping element.

5. The fuel injector as recited in claim 1, wherein:

the valve needle, together with the damping element slipped over the valve needle, may be inserted into the recess.

6. The fuel injector as recited in claim 1, further comprising:

a second vulcanizer layer, wherein:

the valve needle, by way of the second vulcanized layer, is connected to the damping element in a force-locking manner.

7. The fuel injector as recited in claim 1, wherein:

an axial length of the damping element is no greater than an axial length of the recess.

8. The fuel injector as recited in claim 1, wherein:

the armature includes at least one axial fuel channel.

* * * * *